US008328122B2

(12) United States Patent
Bedford et al.

(10) Patent No.: US 8,328,122 B2
(45) Date of Patent: Dec. 11, 2012

(54) SPRAYING APPARATUS AND METHOD OF USING THE SAME

(75) Inventors: David Bedford, Hull (GB); Martin Butler, Hull (GB)

(73) Assignee: Reckitt Benckiser (UK) Limited, Slough (GB)

( * ) Notice: Subject to any disclaimer, the term of this patent is extended or adjusted under 35 U.S.C. 154(b) by 0 days.

(21) Appl. No.: 12/913,346

(22) Filed: Oct. 27, 2010

(65) Prior Publication Data

US 2011/0168745 A1 Jul. 14, 2011

Related U.S. Application Data

(63) Continuation of application No. 11/572,428, filed as application No. PCT/GB2005/002848 on Jul. 21, 2005, now abandoned.

(30) Foreign Application Priority Data

Jul. 28, 2004 (GB) ..... 0416801.9

(51) Int. Cl.

| | |
|---|---|
| ***A62C 31/02*** | (2006.01) |
| ***A62C 13/62*** | (2006.01) |
| ***A62C 13/66*** | (2006.01) |
| ***B05B 9/03*** | (2006.01) |

(52) U.S. Cl. ..... 239/589; 239/302; 239/338; 222/635; 222/649

(58) Field of Classification Search ..... 239/649, 239/63, 635, 645–648, 589, 302, 337, 338, 239/590, 599, 600, 601; 222/645–649, 635, 222/630

See application file for complete search history.

(56) References Cited

U.S. PATENT DOCUMENTS

| | | | | |
|---|---|---|---|---|
| 3,398,864 | A * | 8/1968 | Kolodziej | 222/180 |
| RE34,847 | E * | 2/1995 | Muderlak et al. | 222/25 |
| 5,676,283 | A * | 10/1997 | Wang | 222/649 |
| 6,394,310 | B1 * | 5/2002 | Muderlak et al. | 222/1 |
| 7,789,278 | B2 * | 9/2010 | Ruiz de Gopegui et al. | 222/635 |

* cited by examiner

*Primary Examiner* — Len Tran
*Assistant Examiner* — Justin Jonaitis
(74) *Attorney, Agent, or Firm* — Norris McLaughin & Marcus PA

(57) ABSTRACT

An outlet head (22) for a spray device (10), the outlet head (22) comprising an inlet section (31) having an opening (30) adapted to receive an output section (20) of a spray material container (16), said opening (30) forming a first end of a fluid channel for spray material from the spray material container (16), the outlet head (22) also comprising an outlet portion (14) adapted to eject spray material and forming a second end of the fluid channel for spray material, wherein the inlet section (31) has a first, major, lateral axis and a second, minor, lateral axis, said first and second axes being substantially at right angles to one another, wherein the size of the inlet section along the first, major, axis is greater than the size of the inlet section along the second, minor, axis.

14 Claims, 3 Drawing Sheets

SPRAYING APPARATUS AND METHOD OF USING THE SAME

This is a Continuation application of U.S. Ser. No. 11/572,428, which was an application filed under 35 USC 371 of PCT/GB2005/002848.

This invention relates to an apparatus for spraying a fragrance, a pest control material, a deodorizing fluid, or similar, and to a container for use in a spraying apparatus and to a method of spraying.

Prior art devices for spraying fragrances, deodorizing agents and sanitizing fluids into a room consist of a mechanically actuated arm which is periodically activated to press down on a spray head secured to an aerosol canister containing the material to be sprayed.

The prior art devices are typically constructed as follows. An outer casing has an opening through which the spray is ejected. The casing has a removable section which is removed to allow a refill canister containing the spray material to be placed in the casing. A moulded spray head, as shown in FIG. 8, is placed over the outlet stalk of an aerosol spray can. The spray head has an inlet section 31 having an opening 30 to be placed over the outlet stalk of the aerosol canister. The inlet section 31 has a square shape with strengthening pillars at corners of the square. Inner shoulders 34*a,b* bear against the outlet stalk to cause material to be ejected from the canister into the opening 30 and out of an outlet of the spray head (shown in part in FIG. 6). A location block 23 allows location of the spray head in the casing. The actuation arm is located over the spray head and is caused periodically to press against the spray head to cause material from the aerosol can to be ejected through the spray head out of the opening in the casing and into the surroundings. The actuator arm is either battery powered or mains powered and can be set to activate at various time intervals which, for example, may be to activate every seven minutes, every fifteen minutes or every thirty minutes, whichever is set by a user.

It has been found that disadvantages arise with these prior art spraying devices in that the direction of the spray is not well constrained and so the spraying of the material may occasionally miss the opening in the outer casing thereby wasting the spray material and not working efficiently. The spray head may twist sideways away from the outlet in the casing for example.

Furthermore, due to the strength of the movement of the actuation arm required to achieve proper actuation of the aerosol device, there is a tendency for the output stem of the aerosol device to break if there is some mis-alignment between the actuator arm and the aerosol container.

It is an object of the present invention to address the above mentioned disadvantages.

According to a first aspect of the invention there is provided an outlet head for a spray device, the outlet head comprising an inlet section having an opening adapted to receive an output section of a spray material container, said opening forming a first end of a fluid channel for spray material from the spray material container, the outlet head also comprising an outlet section adapted to eject spray material and forming a second end of the fluid channel for spray material, wherein the inlet section has a first, major, lateral axis and a second, minor, lateral axis, said first and second axes being substantially at right angles to one another, wherein the size of the inlet section along the first, major, axis is greater than the size of the inlet section along the second, minor, axis.

Preferably, a distance between outer surfaces of the inlet section along the first, major, axis is greater than a distance between outer surfaces of the inlet section along the second, minor, axis.

Preferably the inlet section is laterally elongate in shape, preferably elongate from front to rear. The shape of the inlet section advantageously deters rotation of the spray head with respect to a remainder of a spray device in which the spray head is adapted to be located.

Preferably the first axis runs substantially between a front and a rear of the inlet section.

Preferably, the opening in the inlet section is generally circular.

Preferably, sidewalls of the inlet section are thicker along the first axis than along the second axis. The thickness of the sidewalls along the first axis advantageously provides strengthening for the inlet section. The relative thinness of the sidewalls along the second axis advantageously provides a reduction in material required for the inlet section.

The ratio of wall thickness along the first axis to the wall thickness along the second axis may be greater than approximately 1.25 to 1, preferably greater than approximately 1.5 to 1, more preferably greater than approximately 1.75 to 1, still more preferably greater than approximately 1.8 to 1.

The walls of the second axis preferably have a thickness of between approximately 0.65 mm and 1.05 mm, preferably between approximately 0.75 mm and 0.95 mm. The walls at the first axis may have a thickness of between approximately 1.4 mm and 1.8 mm, preferably between approximately 1.5 mm and 1.7 mm.

The references herein to approximately maybe omitted.

The reference to a spray device and to spray material may be taken to a general reference to a device that is adapted to eject material in a spray, a jet, in droplets or other fluid form; references to spray material should be interpreted in a similar way.

According to a second aspect of the present invention there is provided a spray material container adapted to be received in the opening of the outlet head described in the first aspect.

According to a third aspect of the present invention there is provided a method of spraying material and preventing damage to an output section of a spray material container, wherein the method comprises using an outlet head for a spray device as described in the first and fourth aspects.

The advantageously narrow opening in the outlet head for receiving the output section of the spray material container reduces the risk of breaking the output section. Also there is advantageously reduced relative movement between the outlet head and the output section.

According to a fourth aspect of the present there is provided an outlet head for a spray device, the outlet head comprising an inlet section having an opening adapted to receive an output section of a spray material container, said opening forming a first end of a fluid channel for spray material from the spray material container, the outlet head also comprising an outlet section adapted to eject spray material and forming a second end of the fluid channel for spray material, wherein the inlet section has a cross-section that is laterally elongate.

The invention extends to a spray material container having a spray head as described in the first aspect attached thereto.

The spray material container may be an aerosol canister.

According to a fifth aspect of the invention there is provided an outlet head for a spray device, the outlet head comprising an inlet section having an opening adapted to receive an output section of a spray material container, said opening forming a first end of a fluid channel for spray material from the spray material container, the outlet head also comprising an outlet section adapted to eject spray material and forming a second end of the fluid channel for spray material, wherein the inlet section has a first and second lateral axes, wherein at least one of said axes is less than or equal to approximately 5 mm in length.

Preferably only one of said first and second axes measures less than or equal to approximately 5.5 mm.

Preferably one of said axes measures approximately 5 mm. Preferably the other of said axes measures approximately 6.5 mm.

The invention extends to a spraying device comprising a casing, activation means and an outlet head as described any of the first, fourth or fifth aspects.

According to another aspect of the invention there is provided an outlet head for a spray device, the outlet head comprising:

an inlet section having an opening adapted to receive an output section of a spray material container, said opening forming a first end of a fluid channel for spray material from the spray material container; and an outlet section adapted to eject spray material and forming a second end of the fluid channel for spray material; wherein the inlet section has a first, major, lateral axis and a second, minor, lateral axis, said first and second axes being substantially at right angles to one another; and wherein a distance between outer surfaces of the inlet section along the first, major, axis is greater than a distance between outer surfaces of the inlet section along the second, minor, axis.

According to another aspect of the invention there is provided an outlet head for a spray device, the outlet head comprising:

an inlet section having an opening adapted to receive an output section of a spray material container, said opening forming a first end of a fluid channel for spray material from the spray material container; and an outlet section adapted to eject spray material and forming a second end of the fluid channel for spray material; wherein the inlet section has an external cross-section that is laterally elongate.

According to another aspect of the invention there is provided an outlet head for a spray device, the outlet head comprising:

an inlet section having an opening adapted to receive an output section of a spray material container, said opening forming a first end of a fluid channel for spray material from the spray material container; and an outlet section adapted to eject spray material and forming a second end of the fluid channel for spray material; wherein the inlet section has a first and second lateral axes, wherein a distance between external surfaces of the inlet section along at least one of said axes is less than or equal to approximately 5 mm.

All of the features described herein may be combined with any of the above aspects, in any combination.

For a better understanding of the invention, and to show how embodiments of the same may be carried into effect, reference will now be made, by way of example, to the accompanying diagrammatic drawings in which.

It has been found that there are some shortcomings in the existing design of spray heads used in prior art types of fragrance spraying device. Firstly, there is some relative movement (primarily a rotation about a vertical axis) between the spray head typically used and the outlet stem of an aerosol canister. This, in conjunction with the forceful movement of the actuator arm, can result in the outlet stem being pushed at an unintended angle and causing fracture or snapping of the outlet stem, which causes the spraying device to malfunction. Also, it has been found that the play between the prior art spray head and the outlet stem of the aerosol canister can cause misdirection of this spray causing it to impinge on the housing of the spraying device, rather than exiting the opening as intended.

Figure 6:
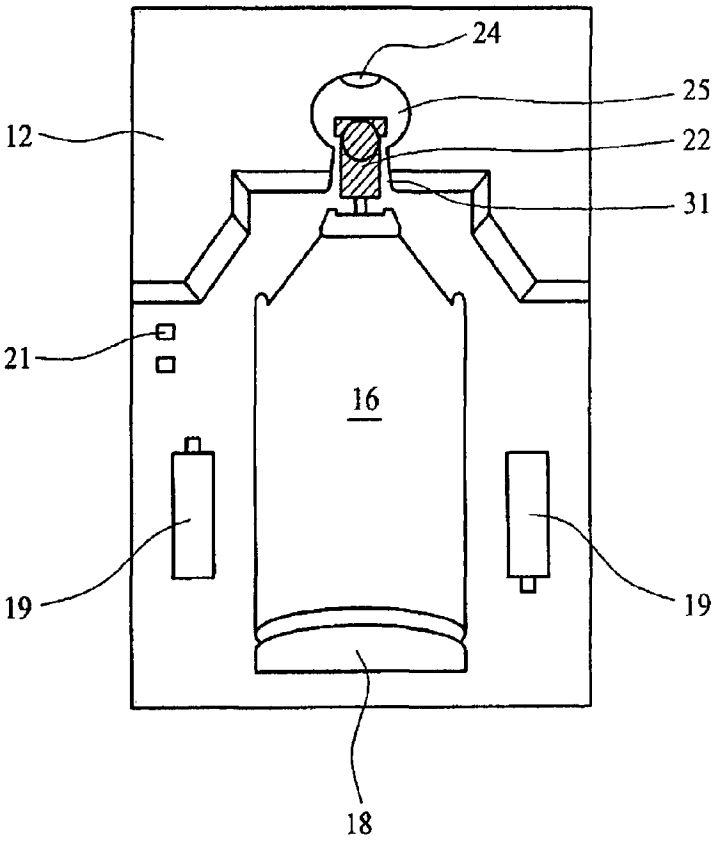
FIG. 6 is a schematic front view of the spraying device shown in FIG. 5.
Figure 5:
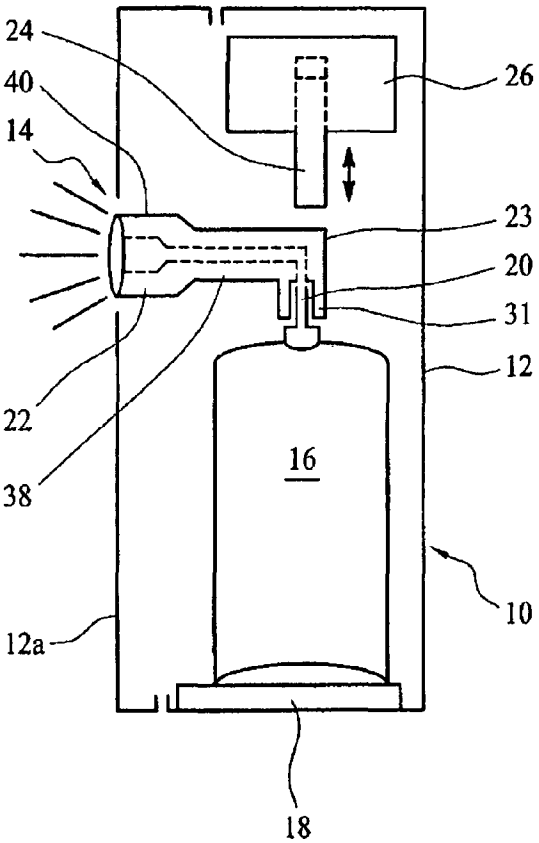
FIG. 5 is a schematic view of a spraying device incorporating the spray head shown in FIGS. 1 to 4.

As shown in FIGS. 5 and 6 a fragrance spraying device 10 comprises a housing 12 in a removable front section 12*a* of which there is an opening 14. An aerosol spray canister 16 is held within the housing 12 on a platform 18. An outlet stem 20 of the spray canister 16 is received in a lower opening in a spray head 22, the details of which will be discussed below. An actuator arm 24 is located above the spray head 22 and is moveable by an actuator 26 to move down onto the spray head 22 and cause activation of the aerosol spray canister 16 to spray material from the opening 14. The actuator 26 is powered by batteries 19 and may have an adjustment control 21.

In use, the aerosol spray canister 16 is placed on the platform 18 and the outlet stem 20 is engaged in a lower opening 30 in the spray head 22. The aerosol spray canister 16 is a replaceable item, whilst the spray head 22 is typically supplied with the aerosol spray canister 16.

When the aerosol spray canister 16 is placed in position a fluid path for fragrance (or sterilizing material or other material) for spraying is formed from the aerosol spray canister 16 through the spray head 22 to the opening 14 in the front section of the housing 12*a* and out into the surrounding atmosphere.

In order to cause spraying of the material within the aerosol spray canister 16 the actuator arm 24 is caused to move down onto the spray head 22 by the actuator 26. The actuator 26 has numerous selectable settings which a user may select with use of the adjustment control 21. The settings may be, for example to cause the actuator arm 24 to move and cause spraying from the aerosol spray canister every nine minutes, every eighteen minutes, every thirty-six minutes or any other of the large number of possible settings, as would be preferred by a user.

Figure 7:
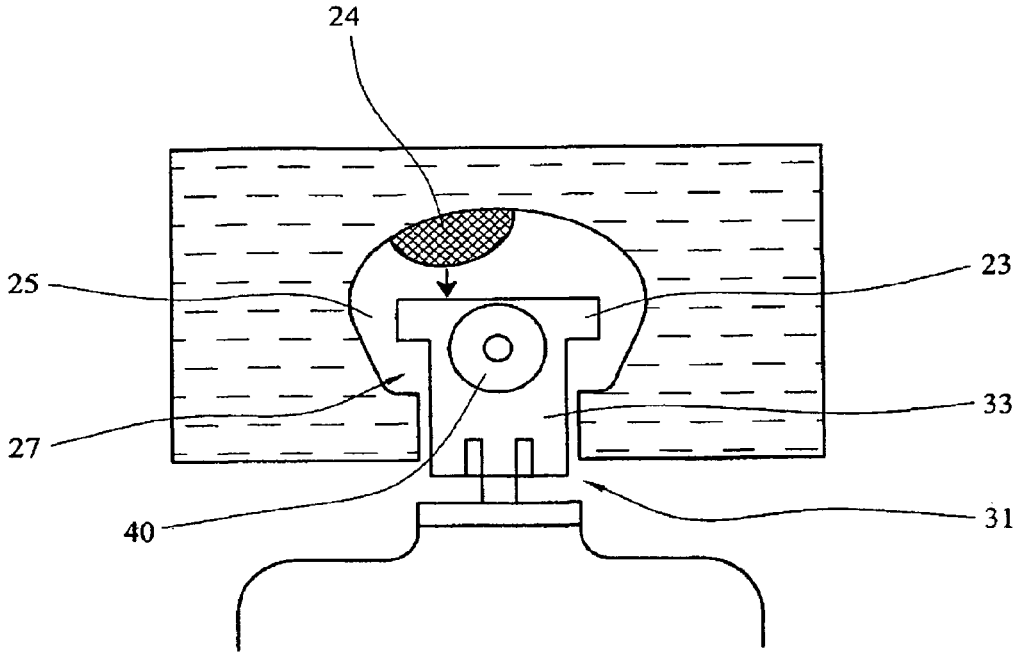
FIG. 7 is a schematic partial front view of the spray head in position in a spraying device.
Figure 8:
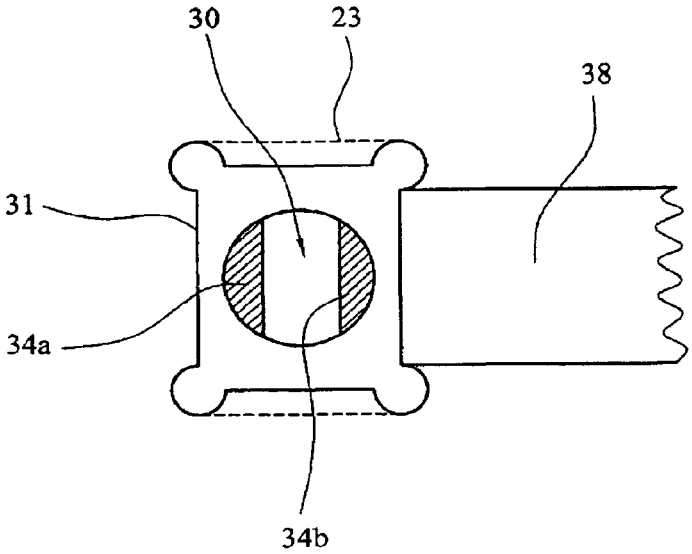
FIG. 8 is a schematic view from below of a prior art spray head, corresponding to the view of the spray head shown in FIG. 2.

In order to locate the spray head 22 with respect to the casing 12 the spray head 22 has a location block 23 above a lower, inlet, section 31 of the spray head 22. The location block 23 is received in a location section 25 of the casing 12, shown in FIG. 7. The location section 25 receives the location block 23, the latter being wider than the inlet section 31. The inlet section 31 is received in a neck section 27 (beneath the location block 25) of the casing 12, which neck section 27 has a close fit with the inlet section 31. Space is allowed below the location block 25 to allow for vertical movement of the spray head 22 relative to the neck 27 when it is activated, so that it does not bear against the top of the neck section 27 when spraying.

It may alternatively be preferable to hold the spray head 22 in position and use the actuator 26 and actuator arm to bear on the canister 16, from beneath. This may result in better accuracy of spray direction.

With the above mentioned shortcomings of prior art devices in mind the revised spray head 22 as shown in FIGS. 1 to 5 has been designed. In order to reduce the relative movement between the spray head 22 and the outlet stem 20 of the aerosol spray canister 16 it has been found surprisingly that great improvements in direction of the spray and reducing the risk of fracture or breakage of the outlet stem can be achieved. In particular a narrowing of the inlet section 31 compared to a prior art spray head and a narrowing of the neck section 27 of the casing provides better constraint of relative movement between the spray head 22 and the casing 12.

The lower opening 30 in the spray head 22 has a chamfered mouth which tapers inward at an angle of 45° to an inner diameter of 2.8 mm. This diameter is less than is typically used in prior art spray heads (which typically have a width of 3.2 mm or 3.0 mm).

Figure 1:
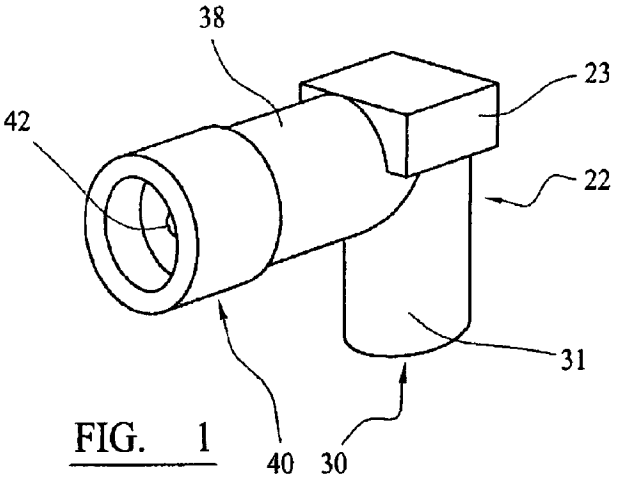
FIG. 1 is a schematic perspective view of a spray head section of a spraying device.
Figure 2:
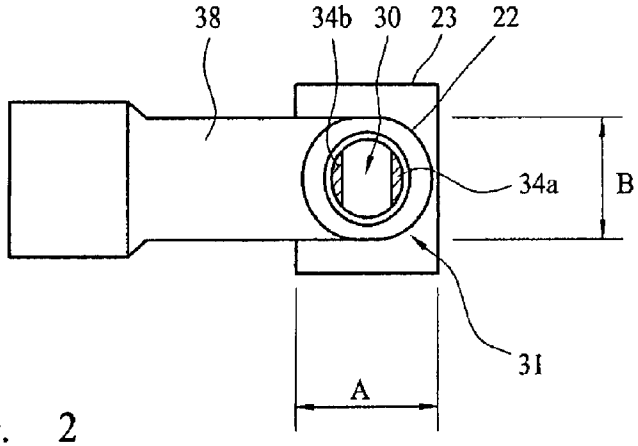
FIG. 2 is a view from below of the spray head shown in FIG. 1.
Figure 3:
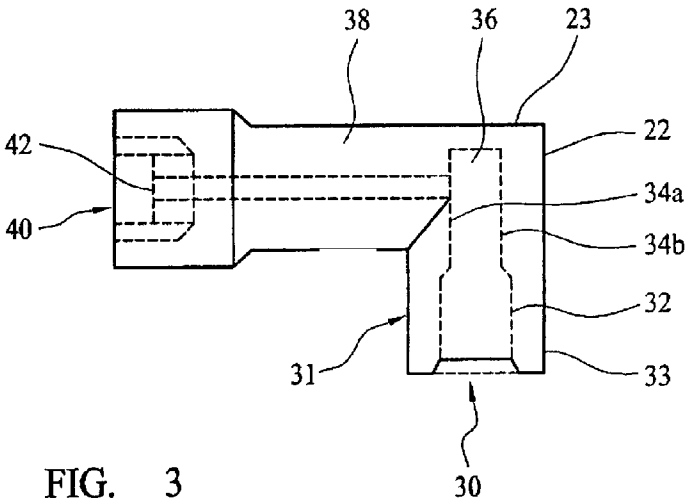
FIG. 3 is a schematic cross-sectional view of the spray head.
Figure 4:
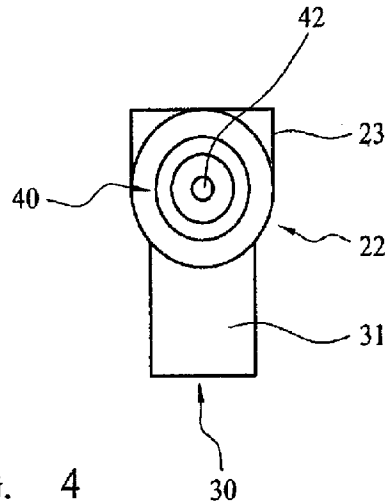
FIG. 4 is a schematic front view of the spray head.

As shown in FIG. 2, the inlet section 31 has a generally oval cross-section, instead of the square shape with strengthening corner posts of the prior art shown in FIG. 6.

From the opening 30 the neck section extends to a shoulder section 32 formed by side walls 34*a* and 34*b*. As can be seen from FIG. 2 the shoulder section 32 changes the shape of the channel from a circular cross-section at the lower opening 30 to a generally oval cross-section above the shoulder section 32. The shoulder section 32 allows the outlet stem 20 of the aerosol spray canister 16 to bear against the shoulder section when pressure is exerted and thereby release material from the aerosol canister 16. The shoulder section 32 causes the width of the passage extending through the spray head 22 to narrow to 2.3 mm. From the shoulder section 32 the side walls 34*a/b* extend upwards continuing the channel through a bend 36 along a horizontal section 38 to a mouth section 40. The mouth section 40 forms a convoluted path through which the material from the aerosol spray canister 16 must pass in order to form a spray of the material to exit the mouth section 40. An insert 42 is present in the mouth section 40 in order to break up this spray.

As can be seen from FIG. 5, the mouth section 40 is aligned with the opening 14 in the housing 12 to allow greater accuracy of ejection of material from the aerosol canister through the opening 14, particularly when the location block 23 is received in the location bracket 25 and the canister 16 is pushed from below.

It has been found that significant advantages have resulted by selectively thickening the side walls 33 of the inlet section 31, in particular the walls 33 at the front and rear of the inlet section 31 as they extend up to the shoulder section 32. The thickening of the walls has resulted in a generally elongate shape from front to rear. This shape deters relative rotation about a vertical axis between the spray head 22 and the neck section 27 of the casing 12. At the sides the walls are approximately 0.85 mm thick, whereas at front and back the walls are approximately 1.6 mm thick. Thus there is a ratio of approximately 1.9 to 1 between the wall thicknesses. This results in considerably less likelihood of misdirection of spray material and/or fracture of the outlet stem 20 in the event that there is mis-alignment of the spray head 22 as the actuator arm 24 presses against the spray head 22, or presses against the canister 16, whichever is the case. In addition, the thinning of the walls at the sides of the inlet section 31 serves to accentuate the oval shape thereof and further reduce the relative relation referred to above. The thinning allows the amount of material used to be reduced, because of the thickening at the front and rear walls.

In order to compensate for the thickening of the walls 33 it has been necessary to make some reduction in the width of the outlet stem 20 of the aerosol spray canister 16 to 2.8 mm so that the outlet stem 20 can still be received in the opening 30 in the spray head 22.

There is a surprising effect achieved by a relatively small thickening of the front and rear walls 33 of the inlet section 31 on the spray head 22. The advantages of greater accuracy of spray and less likelihood of breakage of the outlet stem 20 are significant in a product such as this in which reliable use is required by users.

The aerosol spray canister 16 with the reduced width of outlet stem 20 can be used in conjunction with the spray head 22 described herein, but can also be used with prior art spray heads used with prior art apparatus. Thus, although amendments have been made to a relatively standard design there is no reduction in functionality for the aerosol spray canisters 16 which are usable with the outlet stem 20 described herein.

As described above, the walls 33 have been thickened at the front and rear and thinned at the sides to provide a shape longer from front to back than it is wide. The outer width of the inlet section 31 at the point marked A in FIG. 2 is 6.5 mm. The width taken at 90° to this shown at B in FIG. 2 is 5 mm, which is also the thickness of a first part of the horizontal section 38.

As mentioned above, the main requirement of the lower opening 30 is to reduce the amount of relative movement between the spray head 22 and the casting 12, as well as the outlet stem 20, because of the surprisingly beneficial effects of doing so. Increasing the thickness of the walls 33 selectively, preferably at front and rear, provides the advantages referred to above.

Reference is made in this specification to the spraying device 10 being a fragrance spraying device. The spraying device 20 may also be used for spraying deodorizing material, sanitizing materials or any other material in a spray form. The apparatus described is typically for use in periodic spraying into a closed area such as a room. The apparatus is also being described in relation to the use of an aerosol spray canister 16 for the material to be sprayed. However, different types of container other than an aerosol canister could be used.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An automatic spraying device comprising:

a housing with a removable front section in which there is an opening;

an aerosol spray canister removably held within the housing on a platform;

the housing having a location section in which a spray head of the spray canister is located, the location section having a neck section in which an inlet section of the spray head is received;

an actuator arm located above the spray head which is moveable by an electrically powered actuator to move down into the location section and onto the spray head to cause activation of the aerosol spray canister to spray material from the canister through the opening;

the spray head further comprising:

the inlet section having a generally oval-cross section and further having an opening in the inlet section adapted to receive an output section of the spray material canister, said opening forming a first end of a fluid channel for spray material from the spray material canister, the channel comprises a bend which diverts the direction of the fluid channel, which defines a first part of the fluid channel which extends from the opening to the bend; and an outlet section adapted to eject spray material and forming a second end of the fluid channel for spray material which includes a horizontal section, and a further channel extending from the bend to a mouth section at an end of the horizontal section, which defines a second part of the fluid channel, and wherein the length of the second part of the fluid channel is greater than the length of the first part of the fluid channel;

the inlet section has a first, major, lateral axis and a second, minor, lateral axis, said first and second axes being substantially at right angles to one another; and wherein a distance between the sidewall of the inlet section along the first, major, axis is greater than a distance between the sidewall of the inlet section along the second, minor, axis; and, a location block located axially above the inlet section and said location block being wider than the inlet section along the second, minor, lateral axis and said location block being wider than the neck section of the location section of the device.

2. The automatic spraying device according to claim 1, wherein the inlet section is laterally elongate in shape from front to rear.

3. The automatic spraying device according to claim 1, wherein sidewalls of the inlet section are thicker along the first axis than along the second axis.

4. The automatic spraying device according to claim 1, wherein the ratio of wall thickness along the first axis to wall thickness along the second axis is greater than approximately 1.25 to 1.

5. The automatic spraying device according to claim 1, wherein the walls along the second axis have a thickness of between approximately 0.65 mm and 1.05 mm

6. The automatic spraying device according to claim 1, wherein the walls along the first axis have a thickness of between approximately 1.4 mm and 1.8 mm.

7. An automatic spraying device comprising:

a housing with a removable front section in which there is an opening;

an aerosol spray canister removably held within the housing on a platform;

the housing having a location section in which a spray head of the spray canister is located, the location section having a neck section in which an inlet section of the spray head is received;

an actuator arm located above the spray head which is moveable by an electrically powered actuator to move down into the location section and onto the spray head to cause activation of the aerosol spray canister to spray material from the canister through the opening;

the spray head further comprising:

the inlet section having a generally oval cross-section and further having having an opening in the inlet section adapted to receive an output section of the spray material canister, said opening forming a first end of a fluid channel for spray material from the spray material canister, the fluid channel extending from the opening to a bend which diverts the direction of the fluid channel, defining a first part of the fluid channel; and, an outlet section adapted to eject spray material and forming a second end of the fluid channel for spray material which includes a horizontal section, and a further channel extending from the bend to a mouth section at an end of the horizontal section, which defines a second part of the fluid channel, and wherein the length of the second part of the fluid channel is greater than the length of the first part of the fluid channel;

wherein the inlet section has a first and second lateral axes, wherein a distance between the sidewall surfaces of the inlet section along at least one of said axes is less than or equal to approximately 5 mm; and a location block located axially above the inlet section, said location block being wider than 5 mm along the second, minor, later axis and said location block being wider than the neck section of the location section of the device.

8. An outlet head for an aerosol spray canister adapted for use with an automatic spraying device having a location section having a neck section adapted to receive at least a part of the outlet head, the said outlet head comprising:

an inlet section having a generally oval cross-section and further having an opening adapted to receive an output section of an aerosol spray canister, said opening forming a first end of a fluid channel for spray material from the an aerosol spray canister, which fluid channel comprises a bend which diverts the direction of the fluid channel, which defines first part of the fluid channel which extends from the opening to the bend, wherein the inlet section has a first outer width and a second outer width, wherein the first and second outer widths are are unequal in dimension and substantially at right angles to one another; the inlet section has a sidewall which is thicker at a front and rear of the inlet section than at the sides of the inlet section;

an outlet section adapted to eject spray material and forming a second end of the fluid channel for spray material which includes a horizontal section, and a further channel extending from the bend to a mouth section at an end of the horizontal section, which defines a second part of the fluid channel, and wherein the length of the second part of the fluid channel is greater than the length of the first part of the fluid channel;

a location block located axially above the inlet section, said location block being wider than the inlet section along the second minor later axis and said location block being wider than the neck section of the location section of the device which operates to prevent the location block entering said neck section of said location section.

9. The automatic spraying device according to claim 1 wherein the external dimensions of the inlet section are such that the location block does not bear against a top of the of the neck section of the location section when the contents of the aerosol container are being dispensed.

10. The automatic spraying device according to claim 7 wherein the external dimensions of the inlet section are such that the location block does not bear against a top of the of the neck section of the location section when the contents of the aerosol container are being dispensed.

11. The automatic spraying device according to claim 8 wherein the external dimensions of the inlet section are such that the location block does not bear against a top of the of the neck section of the location section when the contents of the aerosol container are being dispensed.

12. An outlet head for an aerosol spray canister according to claim 1, wherein the ratio of wall thickness of the sidewall at the front and rear of the inlet section to the wall thickness of the sidewall at the sides is greater then or equal to 1.25 to 1.

13. An outlet head for an aerosol spray canister according to claim 12, wherein the wall thickness of the sidewall at the front and rear of the inlet section is from about 0.65 mm to about 1.05 mm.

14. An outlet head for an aerosol spray canister according to claim 12, wherein the wall thickness of the sidewall at the front and rear of the inlet section is from about 1.4 mm to about 1.8 mm.

* * * * *